US011168486B2

(12) United States Patent
Huang et al.

(10) Patent No.: US 11,168,486 B2
(45) Date of Patent: Nov. 9, 2021

(54) ABOVE GROUND POOL

(71) Applicant: BESTWAY INFLATABLES & MATERIAL CORP., Shanghai (CN)

(72) Inventors: Shui Yong Huang, Shanghai (CN); Pei Cai, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 17/007,234

(22) Filed: Aug. 31, 2020

(65) Prior Publication Data

US 2020/0399919 A1 Dec. 24, 2020

Related U.S. Application Data

(63) Continuation of application No. 15/794,880, filed on Oct. 26, 2017, now Pat. No. 10,760,291.

(30) Foreign Application Priority Data

Jun. 27, 2017 (CN) ..... 201720756181.X

(51) Int. Cl.
*E04H 4/00* (2006.01)

(52) U.S. Cl.
CPC ..... *E04H 4/005* (2013.01); *E04H 4/0025* (2013.01); *E04H 4/0031* (2013.01); *E04H 2004/0068* (2013.01)

(58) Field of Classification Search
CPC ..... E04H 4/005
(Continued)

(56) References Cited

U.S. PATENT DOCUMENTS

2014/0157509 A1* 6/2014 Lan ..... E04H 4/0031 4/506

FOREIGN PATENT DOCUMENTS

GB 1594430 A * 7/1981 ..... E04H 4/0056

* cited by examiner

*Primary Examiner* — Christine J Skubinna
(74) *Attorney, Agent, or Firm* — Dickinson Wright PLLC

(57) ABSTRACT

The present invention provides a above ground pool, comprising a flexible pool body. The flexible pool body comprises: a polygonal bottom sheet that comprises a plurality of edge portions; and a plurality of side sheets, each side sheet comprising a pool sidewall portion and a pool bottom portion, and each of the pool sidewall portions and each of the pool bottom portions being in the shape of an isosceles trapezoid. Each of pool sidewall portion comprises a first upper-base portion, a first lower-base portion and a first middle portion defined between the first upper-base portion and the first lower-base portion, and each of the pool bottom portion comprises a second upper-base portion, a second lower-base portion and a second middle portion defined between the second upper-base portion and the second lower-base portion. The first lower-base portion and the second lower-base portion coincide to define a junction of the pool sidewall portion and pool bottom portion. The first middle portions of the side sheets are successively connected to form a side wall of the above ground pool and the second middle portions are successively connected to form an outer ring of the bottom of the above ground pool. The second upper-base portions of the pool bottom portions are respectively connected to the edge portions of the bottom sheet. In the above ground pool of the present invention, joints are moved to a side wall of the swimming pool or the bottom of the swimming pool as much as possible, thereby reducing the length of joints passing through a heavily stressed area to the greatest extent, simplifying production processes, reducing costs, and reducing the probability of water leakage from the above ground pool.

34 Claims, 7 Drawing Sheets

(58) Field of Classification Search
USPC ..... 4/506
See application file for complete search history.

ABOVE GROUND POOL

CROSS REFERENCE TO RELATED APPLICATIONS

This application is a continuation of U.S. application Ser. No. 15/794,880 filed Oct. 26, 2017, which claims the benefit and priority of Chinese Application No. 201720756181.X, filed Jun. 27, 2017. The entire disclosures of which are incorporated herein by reference in their entirety.

FIELD OF THE INVENTION

The present invention relates to the field of pools, in particular to a above ground pool.

BACKGROUND

A above ground pool is a recreational product installed on a piece of vacant land for outdoor use, for example, it can be installed in a family yard or other vacant land for adults and children to play together. Due to convenient installation and good effect of usage, the above ground pool is widely popular.

In the prior art, a ground swimming pool is typically a flexible pool made of plastic, and a pool bottom and a pool wall of the swimming pool are generally made separately by way of clipping and then spliced together. For example, a self-elevating above ground pool is formed by a side wall, a connection sheet and a bottom sheet. Defects of such a pool structure lie in more welding seams, which not only increase the complexity of the process during production and the cost of the product, but also increases the probability of water leakage.

As another example, a rectangular above ground pool is formed by four side sheets, a bottom sheet and four corner side sheets. The bottom welding seam which is under great water pressure is disposed at the junction of the pool bottom and the side wall, which is easy case water leakage.

SUMMARY

It is an object of the invention therefore to propose a structurally simple and effective solution for reducing the number of welding seams of the pool and reducing the cost of the product.

To this end, it is anticipated, according to the invention, that a swimming pool as recited in the above preamble be characterized in that the side wall of the pool may extend to the bottom of the pool to reduce the number of welding seams of the pool.

The above ground pool may comprise a flexible pool body, wherein the flexible pool body may comprise a polygonal bottom sheet, that comprises a plurality of edge portions; and a plurality of side sheets, each of the side sheets being of an integral structure and comprising a pool sidewall portion and a pool bottom portion, and each of the pool sidewall portions and each of the pool bottom portions being in the shape of an isosceles trapezoid.

Wherein each of the pool sidewall portions comprises a first upper-base portion, a first lower-base portion and a first middle portion defined between the first upper-base portion and the first lower-base portion, and each of the pool bottom portions comprises a second upper-base portion, a second lower-base portion and a second middle portion defined between the second upper-base portion and the second lower-base portion; the first lower-base portions and the second lower-base portion coincide to define a junction of the pool sidewall portion and pool bottom portion.

And wherein the first middle portions are successively connected to form a side wall of the above ground pool, and the second middle portions are successively connected to form an outer ring of the bottom of the above ground pool; and the second upper-base portions of the pool bottom portions are respectively connected to the edge portions of the bottom sheet.

Preferably, the side sheets are connected to one another by welding, and the side sheets are connected to the bottom sheet by welding to form the pool body.

Preferably, the plurality of edge portions of the polygonal bottom sheet are respectively welded to the pool bottom portions of the side sheets, thereby forming corresponding first welding seams near the second upper-base portions, and a width of each of the first welding seams is 1.5±0.5 cm.

Preferably, the second middle portions of the side sheets are connected to one another by welding and form second welding seam, and a width of each of the second welding seams is 2-3 cm.

Preferably, the first middle portions of the side sheets are connected to one another by welding and form third welding seam, and a width of each of the third welding seams is 3±0.5 cm.

Preferably, the second welding seams is in a shape of a trapezoid, each of the second welding seams comprising a third upper-base and a third lower-base, a length of the third upper-base is 2 cm, and a length of the third lower-base is 3 cm.

Preferably, the polygonal bottom sheet is an equilateral polygon; and a ratio of a height of the isosceles trapezoid of the pool bottom portion of the respective side sheet to an apothem of the equilateral polygon of the bottom sheet is 1:10-1:15.

Preferably, the bottom sheet is made of a PVC material; and each of the side sheets is made of a fabric PVC. Preferably, the above ground pool further comprising: a circular inflatable ring welded to the first upper-base, and the above ground pool forms a self-elevating pool.

The present invention further provides A above ground pool comprising: a flexible pool body, wherein the pool body comprises: one or more main splice sheets, each of the one or more splice sheets comprising an intermediate portion and first and second side portions disposed on two opposite ends of the intermediate portion, each of the one or more main splice sheets comprising two first edge portions spliced to one another, the intermediate portions of the one or more main splice sheets being connected to one another to form a pool bottom portion, the first side portions being connected to one another to form a first pool sidewall portion, the second side portions being connected to one another to form a second pool sidewall portion; and A plurality of end sheets each of which comprises a second edge portion and a third edge portion, the second edge portions of the end sheets being connected to the pool bottom portion of the one or more main splice sheets.

Preferably, the pool body further comprises a plurality of corner sheets, each of the corner sheets comprising two fourth edge portions, and one of the two fourth edge portions is connected to the respective third edge portion of the respective end sheet, and another one of the two fourth edge portions is connected to the pool sidewall portion of the one or more main splice sheets, so that the corner sheet is connected between the respective end sheet and the respective pool sidewall portion of the one or more main splice sheets.

Preferably, the one or more main splice sheets, the plurality of end sheets and the plurality of corner sheets are connected to each other by welding.

Preferably, the one or more main splice sheets are rectangular or square, the plurality of end sheets are rectangular or square, the plurality of corner sheets have a shape similar to a triangle, and the pool body in use is formed into a cuboid or a cube.

Preferably, a width of a welding seam formed by two adjacent main splice sheets welded to one another is 4±0.5 cm.

Preferably, a width of a welding seam formed by welding the plurality of end sheets to the one or more of main splice sheets is 7±1 cm.

Preferably, a width of a welding seam formed by welding the plurality of corner sheets to the one or more main splice sheets and a width of a welding seam formed by welding the plurality of corner sheets to the plurality of respective end sheets are both 4±0.5 cm.

Preferably, the one or more of the main splice sheets, the plurality of end sheets and the plurality of corner sheets are all made of a fabric PVC.

Preferably, the above ground pool further comprising a support assembly, and the support assembly comprises a support frame and a pull belt for supporting the pool sidewall portion.

The positive progressive effects of the present invention lie in:

In the above ground pool of the present invention, joints are disposed to the side wall of the swimming pool or the bottom of the swimming pool as much as possible, thereby reducing the number of welding seams which carries a greater pressure, simplifying production processes, reducing costs, and reducing the probability of water leakage from the above ground pool.

BRIEF DESCRIPTION OF THE DRAWINGS

The invention will be better understood from reading the detailed description of certain embodiments which are given merely by way of non limiting examples. In this description, reference is made to the appended drawings, in which.

DETAILED DESCRIPTION

Figure 1:
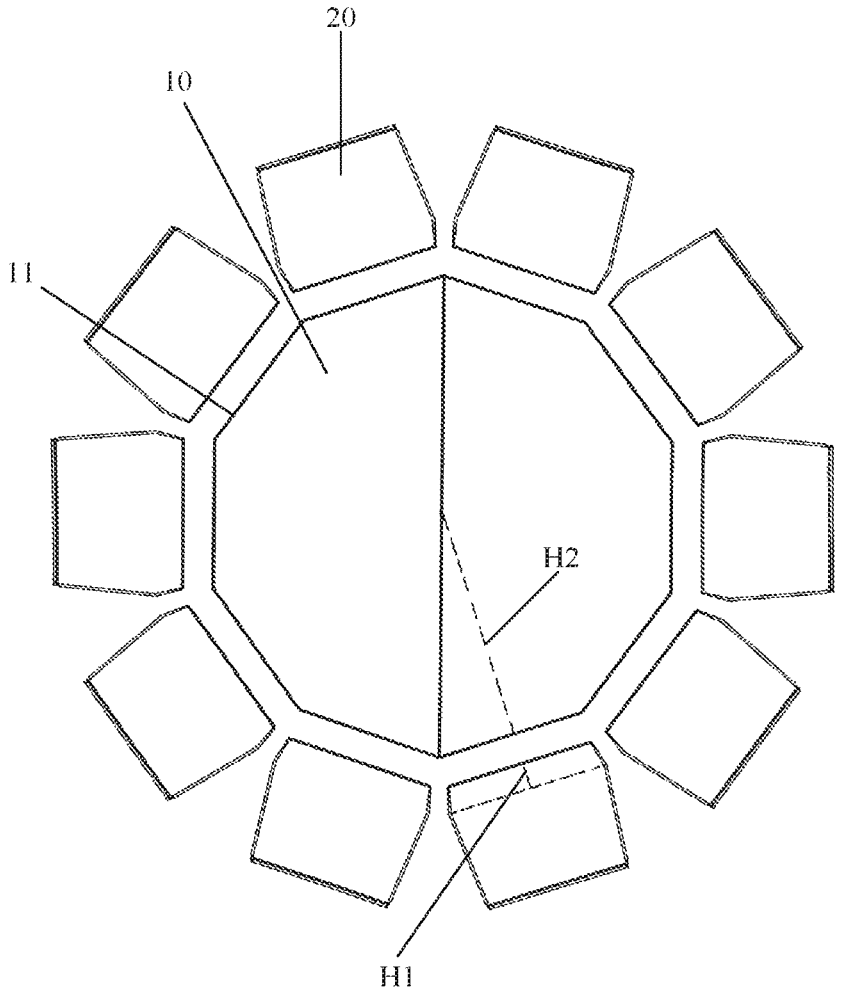
FIG. 1 is a schematic view of expanded sheets of a first embodiment of a above ground pool of the present invention.

To make the above-mentioned object, features and advantages of the present invention apparent and easily understood, a detailed description of particular embodiments of the present invention is made in conjunction with the drawings.

Embodiments of the present invention will now be described in detail with reference to the accompanying drawings. Reference now will be made in detail to preferred embodiments of the present invention, examples of which are illustrated in the accompanying drawings. The same reference numerals in all the figures denote the same or similar parts wherever possible. Furthermore, although the terms used in the present invention are selected from well-known common terms, some of the terms mentioned in the description of the present invention may be selected by the applicant according to his or her judgment, and the detailed meaning thereof is described in the relevant section described herein. Furthermore, the present invention must be understood, not simply by the actual terms used but also by the meanings encompassed by each term.

Figure 2:
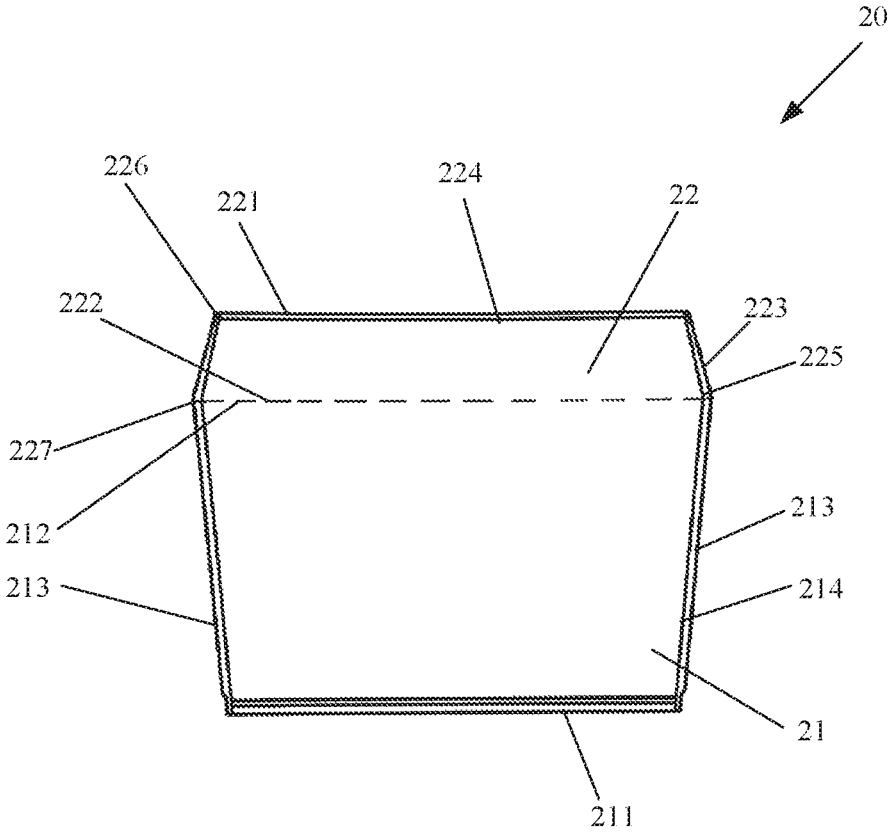
FIG. 2 is a schematic view of a side sheet of the first embodiment of the above ground pool of the present invention.

As shown in FIG. 1 and FIG. 2, the above ground pool comprises a flexible pool body, wherein the flexible pool body comprises a polygonal bottom sheet 10 and a plurality of side sheets 20. The bottom sheet 10 comprises a plurality of edge portions 11 (the polygon comprises multiple edges, and each edge corresponds to each of the edge portions 11 of the polygonal bottom sheet). Each side sheet 20 is an integral structure, and each side sheet 20 comprises a pool sidewall portion 21 and a pool bottom portion 22. The pool sidewall portion 21 and the pool bottom portion 22 are both in the shape of an isosceles trapezoid. The pool sidewall portion 21 comprises a first upper-base portion 211, a first lower-base portion 212 and a first middle portion 213 defined between the first upper-base portion and the first lower-base portion. The pool bottom portion 22 comprises a second upper-base portion 221, a second lower-base portion 222 and a second middle portion 223 defined between the second upper-base portion and the second lower-base portion. The first lower-base portion 212 and the second lower-base portion 222 coincide to define a junction of the pool sidewall portion 21 and the pool bottom portion 22.

The first middle portions 213 of the side sheets 20 are successively connected to form a side wall of the above ground pool. The second middle portions 223 are successively connected to form an outer ring of the bottom of the above ground pool. The second upper-base portions 221 of pool bottom portions are connected to the edge portions 11 of the bottom sheet 10. In other words, the side sheets 20 are connected to one another to form the side wall of the above ground pool and part of the pool bottom. The pool sidewall portion 21 and the pool bottom portion 22 of the side sheet are bent relative to each other to form a certain angle. The bottom of the above ground pool consists of the bottom sheet 10 and the pool bottom portions of the side sheets 20 when in use.

The side sheets 20 are connected to one another by welding, and the side sheets 20 are welded to the bottom sheet 10 and form the pool body. The edge portions 11 of the polygonal bottom sheet 10 are respectively welded to the pool bottom portions of the side sheets 20, thereby forming corresponding first welding seam 224 are formed near the second upper-base portions 221. The width of each of the first welding seams 224 is 1.5±0.5 cm.

In addition, the second middle portions 223 of the side sheets 20 are connected to one another by welding and form second welding seam, and the width of the second welding seam 225 is 2-3 cm. The first middle portions 213 of the side sheets 20 are connected to one another by welding and form third welding seam, and the width of the third welding seam 214 is 3±0.5 cm.

In a preferred example, each of the second welding seams 225 is in the shape of a trapezoid. Each of the second welding seam 225 comprises a third upper-base 226 and a third lower-base 227, wherein the length of the third upper-base 226 is 2 cm, and the length of the third lower-base 227 is 3 cm.

In a preferred example, the polygonal bottom sheet 10 can be an equilateral polygon, and a ratio of a height H1 of the isosceles trapezoid of each pool bottom portion 22 of the respective side sheet 20 to an apothem H2 of the equilateral polygon of the bottom sheet 10 is 1:10-1:15. In a preferred example, the ratio of H1 to H2 is 1:12. The apothem of the equilateral polygon of the bottom sheet 10 is a perpendicular distance from the centre of the equilateral polygon to the edge of the equilateral polygon. The bottom sheet 10 can be made of a PVC material, and the side sheet 20 can be made of a fabric PVC. In a further example, the bottom sheet 10 and the side sheet 20 both can be made of fabric PVC.

Figure 3:
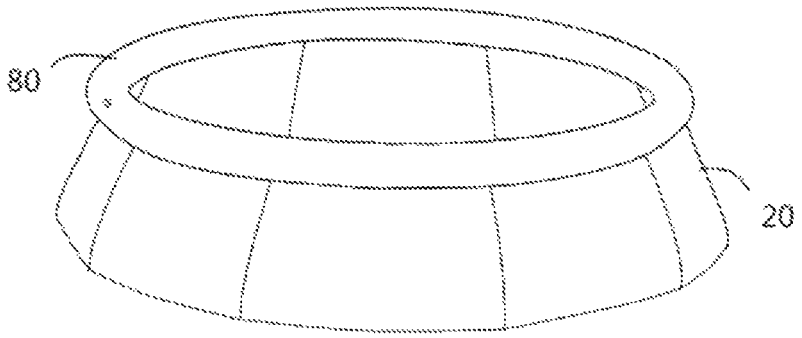
FIG. 3 is a structural schematic view of the first embodiment of the above ground pool of the present invention.
Figure 4:
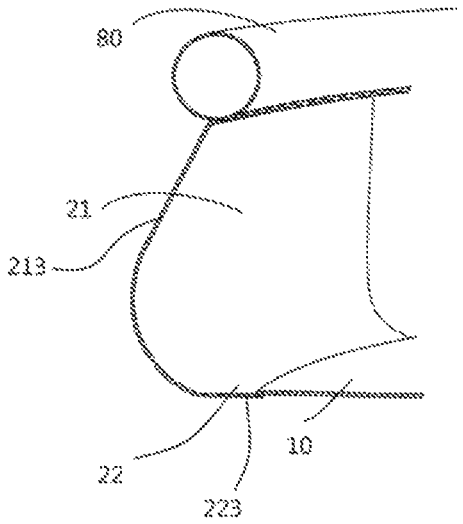
FIG. 4 is a partial enlarged view of the structure of the first embodiment of the above ground pool of the present invention.
Figure 5:
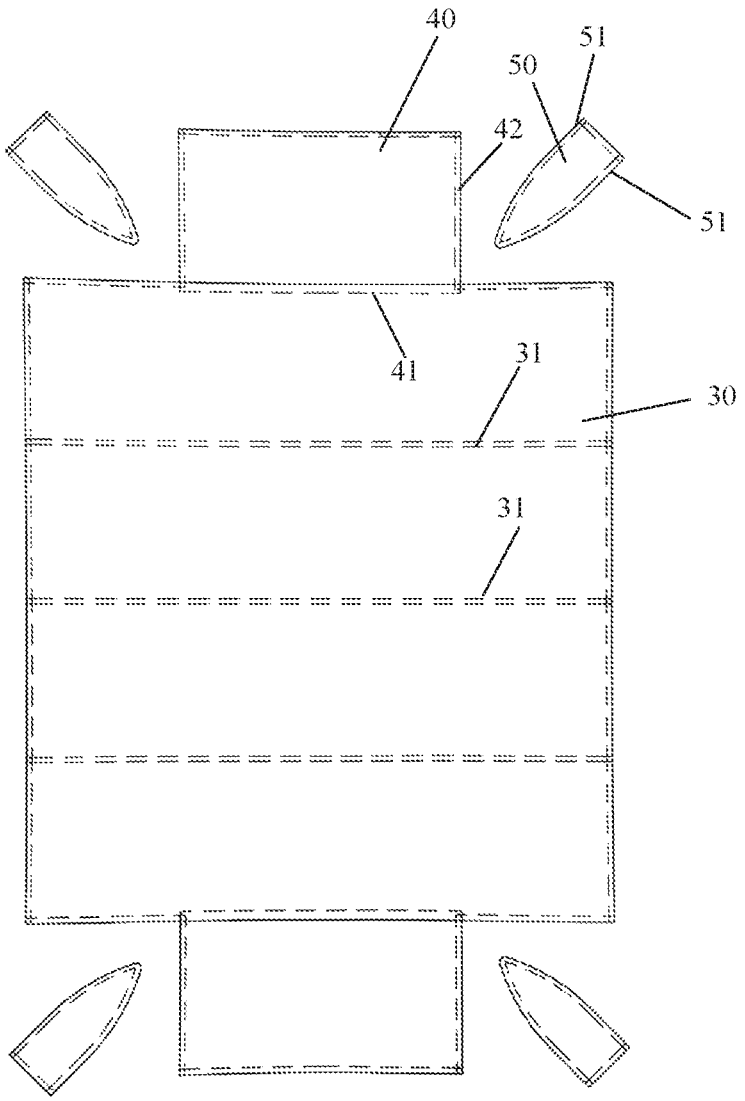
FIG. 5 is a first schematic view of expanded sheets of a second embodiment of the above ground pool of the present invention.
Figure 6:
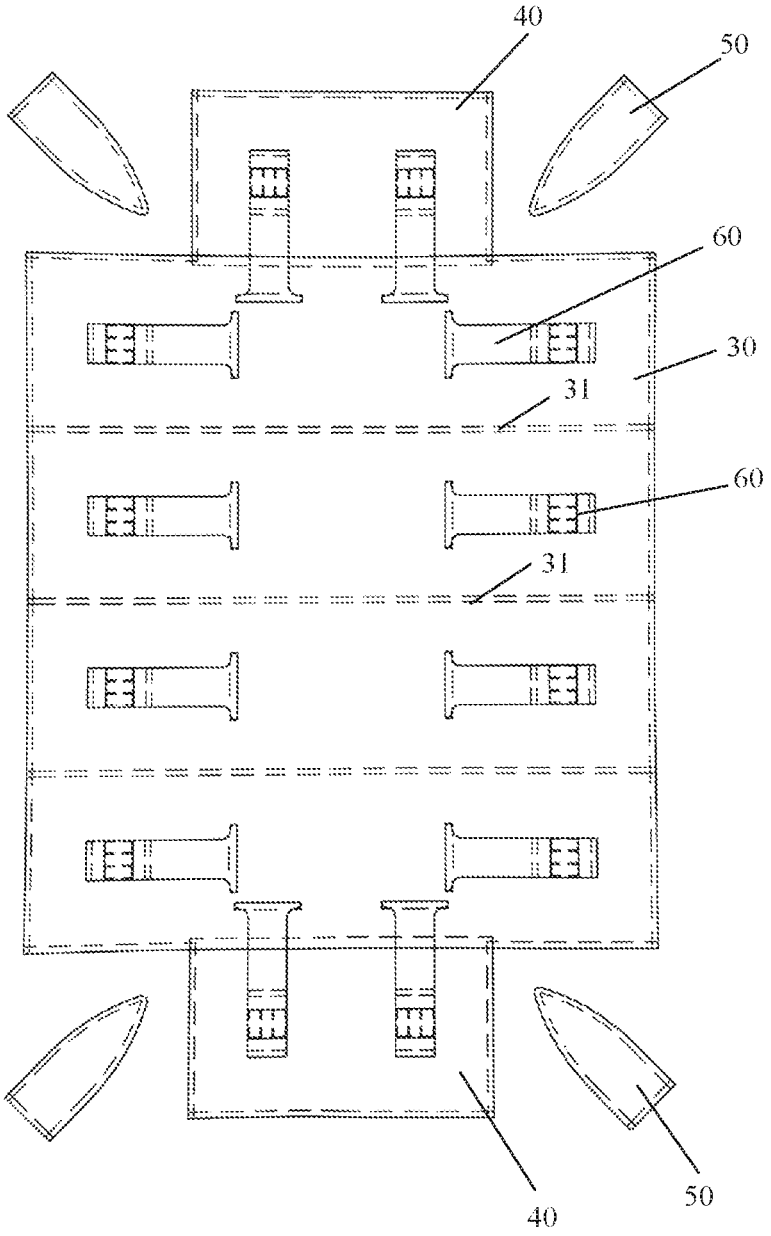
FIG. 6 is a second schematic view of expanded sheets of the second embodiment of the above ground pool of the present invention.
Figure 7:
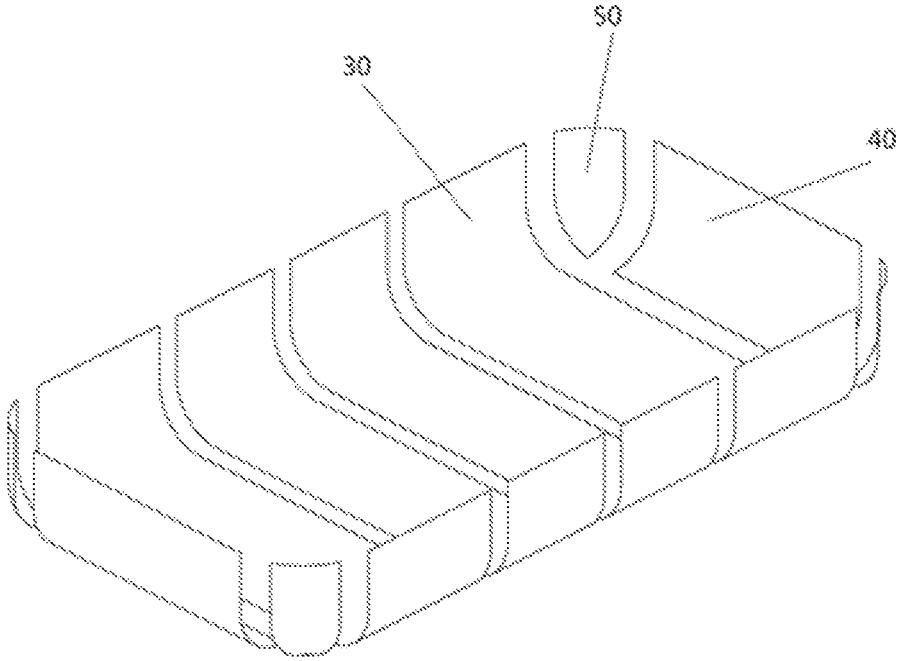
FIG. 7 is a schematic view of welding of the second embodiment of the above ground pool of the present invention.
Figure 8:
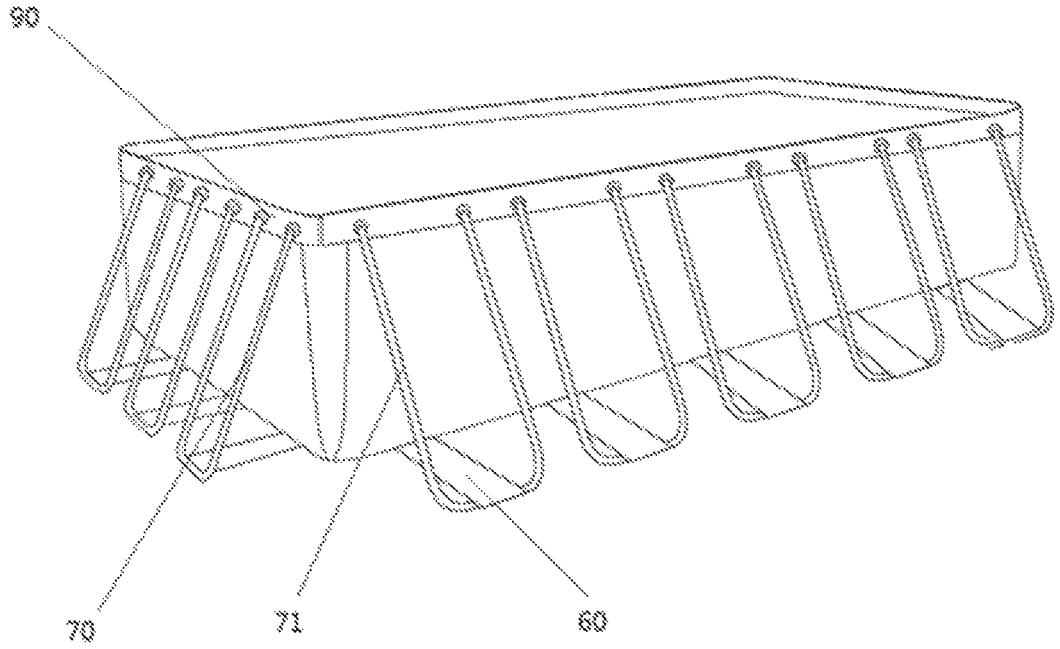
FIG. 8 is a perspective view of the second embodiment of the above ground pool of the present invention.

As shown in FIG. 3 and FIG. 4, the above ground pool mentioned above further comprises a circular inflatable ring 80. The inflatable ring 80 is welded to the first upper-base portion 211 such that the above ground pool forms a self-elevating pool (or self-supporting pool). The inflatable ring is made of a fabric PVC and forms an annular inflatable cavity. When in use, firstly the inflatable cavity is filled with air, then the pool is filled with water, the inflatable cavity is floated on the water and the pool is elevated along with the rising water surface. In a further example, the first upper-base portion 211 is in shape of an inward-concave arc, and the notch of the arc-shaped recess faces downward (not shown in the FIG. 2). In the self-elevating pool, the side sheets are welded to one another, and the first upper-base portions 211 of the side sheets are connected to one another to form a circle (now, the arc-shaped recess faces upward) and is suited to be connected to the circular inflatable ring 80 of the self-elevating pool.

According to the above-mentioned structure, the production process of the pool body of the above ground pool comprises the following steps, Providing side sheets 20 and a bottom sheet 10.

Connecting first middle portions 213 of pool sidewall portions 21 of the side sheets 20 with one another by welding to form an annular pool sidewall portion 21.

Bending pool bottom portions 22 of the side sheets 20 toward the interior of the annular pool wall relative to the pool sidewall portions 21, and then connecting second middle portions 223 of the pool bottom portions 22 of the side sheets 20 with one another by welding to form an annular outer ring at the bottom of the pool wall.

Connecting second upper-base portions 221 of the pool bottom portions 22 to edge portions 11 of the polygonal bottom sheet 10 by welding respectively to form a pool body.

When the above ground pool is a self-elevating pool, the following steps are added.

Providing an inflatable ring 80, and welding first upper-base portions 211 of the pool sidewall portions 21 of the side sheets 20 to the inflatable ring 80.

In summary, the above ground pool is formed by splicing according to the above-mentioned technical solutions, and welding seams are disposed at the bottom of the swimming pool. When the swimming pool is filled with water, the junction of joints of a first middle portion of the pool sidewall portion and the second middle portion of the pool bottom portion is under a relatively large stress, so that the joint of the welding seams are not under a relatively large stress, thereby reducing the probability of water leakage.

As shown in FIG. 3 to FIG. 8, the present invention further provides a above ground pool, which comprises a flexible pool body. The pool body comprises one or more main splice sheet 30, a plurality of end sheets 40 and a plurality of corner sheets 50. Each of the one or more splice sheet 30 comprises an intermediate portion and first and second side portions disposed on two opposite ends of the intermediate portion. The intermediate portions of the main splice sheets 30 are welded to one another to form a pool bottom portion, and the side portions on two sides are welded to one another to form a pool sidewall portion. Each of the one or more main splice sheets 30 comprises two first edge portions 31 spliced to one another. The first edge portions 31 of the main splice sheets 30 are welded to one another.

The plurality of end sheets 40 comprises second edge portions 41 and third edge portions 42, wherein the second edge portions 41 of the end sheets 40 are welded to the pool bottom portion of the main splice sheets 30, that is, the second edge portions 41 of the end sheets 40 are welded to the intermediate portions of the first edge portions 31 of the main splice sheets 30.

Each corner sheet 50 comprises two fourth edge portions 51. The two fourth edge portions 51 are respectively connected to the third edge portions 42 of the end sheets 40 and the pool sidewall portion of the main splice sheets 30 (that is, the third edge portions 42 of the end sheets 40 are welded to one fourth edge portion 51 of the corner sheet 50, and the first edge portion 31 adjacent to the intermediate portion of the main splice sheet 30 is welded to a another fourth edge portion 51 of the corner sheet 50), so that the corner sheet 50 is connected between the end sheet 40 and the pool sidewall portion of the main splice sheets 30.

In a preferred example, the main splice sheet 30 can be configured as a rectangle or a square. The end sheet 40 can be configured as a rectangle or a square. The corner sheet 50 can be configured to have a shape similar to a triangle such as a bullet shape, that is, the corner sheet 50 comprises three edges of two identical side edges and one bottom edge. The side edge is formed of two portions of a linear portion and a curved portion. The linear portion is connected to the bottom edge. The curved portions of the two fourth edge portions 51 are connected to each other. The curved portion of the fourth edge portion 51 is an outward-convex arc. The pool body in use is formed into a cuboid or a cube. The corner sheet 50 can buffer the stress between the pool sidewall portion of the main splice sheet 30 and the end sheet 40 during use. The water pressure at the junction of two side walls of a rectangular or square pool is maximum. The corner sheet 50 is welded to the end sheet and the pool sidewall portion of the main splice sheet 30, respectively. The welding seam keeps away from the junction of the two side walls, that is, the junction of the adjacent two side walls of the pool under maximum water pressure has no weld, which greatly reduces the probability of water leakage.

The width of a welding seam formed by two adjacent main splice sheets 30 is 4±0.5 cm. The width of a welding seam formed by the main splice sheet 30 and the end sheet 40 is 7±1 cm.

The width of a welding seam of the corner sheet 50 and the main splice sheet 30 and the width of a welding seam of the corner sheet 50 and the end sheet 40 are both 4±0.5 cm.

In the present embodiment, the main splice sheets 30, the end sheets 40 and the corner sheets 50 are all made of a fabric PVC.

In addition, the above ground pool further comprises a support assembly. The support assembly comprises support frames 70 and pull belts 60 for supporting the pool sidewall portion. The support frames 70 comprise a support frame for an upper part of the pool body and a support frame for the side wall of the pool body. A shaft sleeve 90 is connected to the pool body. The support frame for the upper part of the pool body can be inserted into the shaft sleeve 90. The support frame 71 for the side wall of the pool body is connected to the support frame for the upper part of the pool body (not shown in the figures). Meanwhile, one end of the pull belt 60 is welded to the bottom of the pool body, and the other end is connected to the support frame for the side wall of the pool body.

The arrangement of the pull belt 60 is as follows. Two pull belts 60 extend from the pool bottom portion of each main splice sheet 30 (from the pool bottom). The support frame for the upper part of the pool body above the pool sidewall portion of each main splice sheet 30 extends downward the support frame for the side wall of the pool body. The pull belt 60 can be connected to the support frame.

In a further embodiment, the pool body can comprise a plurality of main splice sheets 30 and a plurality of end sheets 40, and each end portion of the pool body can comprise two to three or more end sheets 40.

According to the above-mentioned structure, the production process of the above ground pool of the present embodiment comprises the following steps.

Providing main splice sheets, end sheets and corner sheets.

Connecting two side edges to first edge portions 31 of two main splice sheets by welding respectively.

Connecting the first edge portions 31 of the main splice sheets with one another by welding.

Connecting two side edges of the corner sheets to second edge portions 41 of the end sheets and side edges of pool walls of the main splice sheets by welding respectively to form a pool body.

Connecting the pull belt 60 to the bottom of the pool body by welding.

Providing a shaft sleeve 90, and connecting two side edges of the shaft sleeve 90 with each other by welding.

Connecting the shaft sleeve to the pool body by welding.

In summary, in the above ground pool of the present invention, welding seams are disposed to a side wall of the swimming pool or the bottom of the swimming pool as much as possible, thereby reducing the number of welding seams which carries a greater pressure, simplifying production processes, reducing costs, and reducing the probability of water leakage from the above ground pool.

While the particular embodiments of the present invention have been described, a person skilled in the art should understand that these are merely illustrative, and that the scope of protection of the present invention is defined by the appended claims. Various alterations or modifications can be made by a person skilled in the art to these embodiments without departing from the principle and substance of the present invention; however, these alterations and modifications all fall within the scope of protection of the present invention.

What is claimed is:

1. An above ground pool, comprising:

a support frame;

a pool body supported by the support frame and having a bottom wall, a pair of side walls and a pair of end walls, the pool body constructed of a flexible material and including:

a plurality of body sheet segments each having a first lengthwise edge and a second lengthwise edge, the first lengthwise edge and the second lengthwise edge each having a first length;

wherein each of the plurality of body sheet segments is coupled to an adjacent one of the plurality of body sheet segments along at least one of the first and second lengthwise edges to form the bottom wall of the pool body;

a pair of end sheet segments each having a lower edge, an upper edge and a pair of side edges, the lower edge of the pair of end sheet segments having a second length;

wherein the lower edge of each of the pair of end sheet segments is coupled to one of the plurality of body sheet segments along one of the first or second lengthwise edges;

wherein the first length is longer than the second length whereby the lower edge of the end sheet segments generally corresponds to a width of the bottom wall of the pool body.

2. The above ground pool of claim 1, further comprising:

a plurality of corner sheet segments extending between and coupled to one of the pair of end sheet segments and one of the plurality of body sheet segments.

3. The above ground pool of claim 2, wherein the plurality of corner sheet segments each has a first side border and a second side border, the first side border being coupled to one side edge of the pair of end sheet segments, and the second side border being coupled to one of the first or second lengthwise edges.

4. The above ground pool of claim 1, wherein each body sheet segment is welded to an adjacent body sheet segment along a length of at least one of the first and second lengthwise edges, respectively.

5. The above ground pool of claim 1, wherein the plurality of body sheet segments each have a generally rectangular shape.

6. The above ground pool of claim 5, wherein the pair of end sheets segments each have a generally rectangular shape.

7. The above ground pool of claim 6, wherein the plurality of corner sheets each has a generally triangular shape and the pool body has a generally cuboid shape.

8. The above ground pool of claim 4, wherein a width of a welding seam formed between adjacent body sheet segments is about 4±0.5 cm.

9. The above ground pool of claim 8, wherein a width of a welding seam, formed at an attachment of a respective one of the end sheet segments to the bottom wall is about 7±1 cm.

10. The above ground pool of claim 9, wherein a width of a welding seam formed by welding the plurality of corner sheet segments to the body sheet segments and a width of a welding seam formed by welding the plurality of corner sheet segments to a respective one of the end sheet segments are 4±0.5 cm.

11. The above ground pool of claim 1, further comprising:

a plurality of pull belts having a first end portion coupled to the bottom wall and a second end portion configured to attach to a portion of the support frame.

12. The above ground pool of claim 11, wherein the support frame has an upper portion configured to connect to a side wall of the pool body and a lower portion configured to engage ground;

wherein the second end portion of the plurality of pull belts is configured to connect to the lower portion of the support frame.

13. The above ground pool of claim 12, wherein the plurality of pull belts are generally parallel to one another and extend generally along a length of each of the side walls of the pool body.

14. An above ground pool comprising:

a support frame having a first end configured to engage a flexible pool body and a second end configured to engage ground;

the flexible pool body supported by the support frame and including:

a plurality of body sheet portions each having a pair of opposing side edge portions, each of the body sheet portions being coupled to an adjacent body sheet portion along one of the side edge portions to form a pool bottom portion;

a pair of end sheet portions each coupled to one of the side edge portions;

a plurality of corner sheets each extending between one of the body sheet portions and one of the end sheet portions, each of the end sheet portions has a lower edge portion that is coupled to one of the side edge portions of one of the body sheet portions;

the lower edge portion of each of the end sheet portions having a first length;

the side edge portions of each of the plurality of body sheet portions having a second length;

wherein the second length is greater than the first length.

15. The above ground pool of claim 14, wherein each of the body sheet portions has a middle portion and a pair of opposing end portions, wherein the middle portion of each of the body sheet portions corresponds to a section of the pool bottom portion.

16. The above ground pool of claim 15, where the opposing end portions of the body sheet portions each correspond to a respective sidewall of the flexible pool body.

17. The above ground pool of claim 16, further comprising:

a plurality of pull belts coupled to the flexible pool body for securing the plurality of body sheet portions to the support frame;

wherein each body sheet portion has a pair of pull belts secured to the middle portion with each of the pull belts extending outwardly beyond a perimeter of a respective one of the sidewalls of the flexible pool body.

18. The above ground pool of claim 17, further comprising:

a plurality of pull belts coupled to the pool bottom portion and extending outwardly beyond a perimeter of a respective one of an end wall of the flexible pool body.

19. The above ground pool according to claim 14, wherein each body sheet portion is coupled to the adjacent body sheet portion by welding.

20. The above ground pool according to claim 14, wherein the lower edge portions of the pair of end sheet portions are coupled to the body sheet portions by welding.

21. The above ground pool of claim 19, wherein a width of a welding seam formed by two adjacent body sheet portions is about 4±0.5 cm.

22. The above ground pool of claim 20, wherein a width of a welding seam, formed by welding each end sheet portion to one of the body sheet portions is about 7±1 cm.

23. An above ground pool having a pool bottom portion, two side walls and two end walls which together form a flexible pool body defining a water cavity, the above ground pool comprising:

a support frame having an upper end configured to engage the walls of the pool and a lower end configured to engage ground;

the flexible pool body including:

a plurality of body sheet segments oriented generally parallel to one another, the plurality of body sheet segments having a middle portion and a pair of end portions, the middle portion of each of the plurality of body sheet segments corresponds to a segment of the pool bottom portion and each of the end portions of the body sheet segments corresponds to a segment of a respective one of the side walls;

each body sheet segment having a pair of opposing lengthwise edges, wherein each body sheet segment is attached to an adjacent body sheet segment along at least one lengthwise edge, the middle portions of the plurality of body sheet segments form the pool bottom portion and the end portions of the plurality of body sheet segments form the respective side walls;

a pair of end sheet portions attached to one of the plurality of body sheet segments along one of the lengthwise edges to form the end walls of the above ground pool; and four corner sheets each having a pair of side edges, one side edge being coupled along a lengthwise edge to an end portion of one of the body sheet segments, another side edge being coupled to an adjacent sidewall of one of the end sheet portions.

24. The above ground pool of claim 23, further comprising at least one pull belt attached on the pool bottom portion of the above ground pool for securing the pool bottom portion of the above ground pool to the support frame of the above ground pool.

25. The above ground pool of claim 24, wherein the at least one pull belt includes:

a first pair of pull belts extending opposite to each other and attached on each one of the plurality of body sheet segments; and a second pair of pull belts extending parallel to each other and attached on each one of the pair of end sheet portions.

26. An above ground pool comprising:

a support frame;

a flexible pool body supported by the support frame and including:

at least one main splice sheet forming a pool bottom portion and first two opposite walls of the above ground pool;

a pair of end sheets attached to the pool bottom portion to form second two opposite walls of the above ground pool; and four corner sheets respectively attached to the adjacent first wall of the first two opposite walls of the above ground pool and the adjacent second wall of the first two opposite walls of the above ground pool.

27. The above ground pool of claim 26, wherein the at least one main splice sheet having a first lengthwise edge and a second lengthwise edge, the first lengthwise edge and the second lengthwise edge each having a first length; and the pair of end sheets each having a lower edge, an upper edge and a pair of side edges; the lower edge of the pair of end sheets having a second length;

wherein the first length is longer than the second length, the lower edge of the end sheets generally corresponds to a width of the pool bottom portion of the flexible pool body.

28. The above ground pool of claim 27, wherein each of the four corner sheets has a first side border and a second side border with the first side border being coupled to one side edge of the pair of end sheets and the second side border being coupled to one of the first or second lengthwise edges.

29. The above ground pool of claim 27, wherein the at least one main splice sheet is welded to an adjacent main splice sheet along a length of at least one of the first and second lengthwise edges, respectively.

30. The above ground pool of claim 26, wherein the at least one main splice sheet have a generally rectangular shape.

31. The above ground pool of claim 26, wherein the pair of end sheets each has a generally rectangular shape.

32. The above ground pool of claim 26, wherein each of the four corner sheets has a generally triangular shape and the flexible pool body has a generally cuboid shape.

33. The above ground pool of claim 26, further comprising at least one pull belt attached on the pool bottom portion of the above ground pool for securing the pool bottom portion of the above ground pool to the support frame of the above ground pool.

34. The above ground pool of claim 33, wherein the at least one pull belt includes:

a first pair of pull belts extending opposite to each other and attached on the at least one main splice sheet; and a second pair of pull belts extending parallel to each other and attached on each end sheet of the pair of end sheets.

* * * * *